US005916865A

United States Patent [19]

Reinhardt et al.

[11] Patent Number: 5,916,865

[45] Date of Patent: Jun. 29, 1999

[54] LIQUID BLEACHING AGENT SUSPENSION

[75] Inventors: Gerd Reinhardt, Kelkheim; Vera Friderichs, Kesten/Mosel; Nicole Horneff, Flörsheim, all of Germany

[73] Assignee: Clariant GmbH, Frankfurt, Germany

[21] Appl. No.: 08/929,320

[22] Filed: Aug. 29, 1997

[30] Foreign Application Priority Data

Aug. 30, 1996 [DE] Germany ..... 196 35 070

[51] Int. Cl.[6] ..... C11D 3/395; C11D 7/18; C11D 7/54; C11D 1/66

[52] U.S. Cl. ..... 510/375; 510/370; 510/421; 510/434; 510/367; 252/186.41

[58] Field of Search ..... 510/367, 370, 510/375, 421, 434; 252/186.41

[56] References Cited

U.S. PATENT DOCUMENTS

| | | | |
|---|---|---|---|
| 3,996,152 | 12/1976 | Edwards et al. | 252/186 |
| 4,283,301 | 8/1981 | Diehl | 252/102 |
| 4,412,934 | 11/1983 | Chung et al. | 252/186.38 |
| 4,772,290 | 9/1988 | Mitchell et al. | 8/107 |
| 4,790,949 | 12/1988 | Dankowski et al. | 252/95 |
| 4,790,952 | 12/1988 | Steichen et al. | 252/186.39 |
| 4,806,260 | 2/1989 | Broze et al. | 252/8.8 |
| 4,879,057 | 11/1989 | Dankowski et al. | 252/99 |
| 5,391,324 | 2/1995 | Reinhardt et al. | 252/543 |
| 5,505,740 | 4/1996 | Kong et al. | 8/111 |

FOREIGN PATENT DOCUMENTS

| | | |
|---|---|---|
| 0098129 | 1/1984 | European Pat. Off. . |
| 0120591 | 10/1984 | European Pat. Off. . |
| 0212723 | 3/1987 | European Pat. Off. . |
| 0217454 | 4/1987 | European Pat. Off. . |
| 0217454 A2 | 4/1987 | European Pat. Off. . |
| 0225654 | 6/1987 | European Pat. Off. . |
| 0225654 A1 | 6/1987 | European Pat. Off. . |
| 0241073 | 10/1987 | European Pat. Off. . |
| 0334405 | 9/1989 | European Pat. Off. . |
| 0337516 | 10/1989 | European Pat. Off. . |
| 0337516 A2 | 10/1989 | European Pat. Off. . |
| 0517996 | 12/1992 | European Pat. Off. . |
| 0598170 | 5/1994 | European Pat. Off. . |
| 0598170 A1 | 5/1994 | European Pat. Off. . |
| 0619368 | 10/1994 | European Pat. Off. . |
| 0626693 | 11/1994 | European Pat. Off. . |
| 0626693 A2 | 11/1994 | European Pat. Off. . |
| 0 629 693 A1 | 12/1994 | European Pat. Off. . |
| 0629690 A1 | 12/1994 | European Pat. Off. . |
| 0629691 A1 | 12/1994 | European Pat. Off. . |
| 0686691 A1 | 12/1994 | European Pat. Off. . |
| 836988 | 6/1960 | United Kingdom . |
| 907356 | 10/1962 | United Kingdom . |
| WO 92/05238 | 4/1992 | WIPO . |
| WO 93/12067 | 6/1993 | WIPO . |
| WO/94/11483 | 5/1994 | WIPO . |

OTHER PUBLICATIONS

Derwent Search Reports.
European search report.
Patent Abstracts of Japan JP 05156293 A (Kao Corp).
Derwent Abstract XP002702203.
Derwent Abstract XP002072204.

*Primary Examiner*—Paul Lieberman
*Assistant Examiner*—John M Petruncio
*Attorney, Agent, or Firm*—Miles B. Dearth

[57] ABSTRACT

Liquid bleaching agent suspension comprising essentially a) a mixture of a $C_8$–$C_{18}$-fatty alcohol, oxyethylated with 1 to 5 units of ethylene oxide, and a $C_8$–$C_{18}$-fatty alcohol, oxyethylated with 6 to 25 units of ethylene oxide, b) a cyclic anhydride, c) an aqueous solution of hydrogen peroxide and d) water.

14 Claims, No Drawings

LIQUID BLEACHING AGENT SUSPENSION

It is known that the bleaching power of per-salts, such as sodium perborates or percarbonates, can be increased considerably by addition of a bleaching activator. Bleaching activators are usually reactive organic compounds having an O-acyl or N-acyl group, which form the corresponding peroxycarboxylic acids in alkaline solution together with a source of hydrogen peroxide. These already have a good bleaching action at temperatures below 60° C. Examples of bleaching activators are tetraacetylethylenediamine (TAED), benzoyloxybenzenesulfonate (BOBS), nonanoyloxybenzenesulfonate (NOBS) and tetraacetylglucoluril (TAGU). Further activators are described in GB-A-836 988, GB-A-907 356, EP-A-98 129 and EP-A-120 591. Nitriles and anhydrides, both in cyclic and in open form, are also potential bleaching activators.

All the bleaching activators described so far have the common feature that they can be stored only in an anhydrous environment, that is to say they are suitable only for use in pulverulent formulations. To improve the storage stability, they are usually employed in granulated or coated form. They are normally not stable in aqueous sytems, since hydrolysis or perhydrolysis already occurs during storage.

To bypass the problem of stability, pourable formulations have been proposed, such as are described, for example, in EP-A-217 454 and EP-A-225 654. In these, the activator, usually TAED, is suspended in an anhydrous medium, for example in polyglycol ethers, in combinations with perborate. These formulations can comprise further constituents, such as surfactants or a builder system based on phosphate or citrate.

A number of aqueous suspensions of organic peracids are furthermore described as liquid bleaching agents. Thus, a suspension of a solid peroxycarboxylic acid in a liquid carrier material which comprises a polymer-based thickener which does not contain starch is described in U.S. Pat. No. 3,996,152. Bleaching agent suspensions based on colloidal silicic acid, xanthanpolysaccharides or agarpolysaccharides are described in EP-A-283 791 and 283 792.

In EP-A-334 405 and 337 516, organic peracids, such as dodecyldipercarboxylic acid, in combination with alkanesulfonate as an anionic surfactant are preferred. The use of ethoxylated alcohols (EP-A-334 405) or fatty acids (EP-A-337 516) is additionally possible. Suspensions of organic peroxycarboxylic acids (DPDDA or phthalimidoperoxycarboxylic acid) in nonionic surfactants having HLB values of between 6.5 and 11 are described in EP-A-386 566 and EP-A497 337.

There is still a need for novel storage-stable liquid bleaching agents. The advantage of such liquid bleaching agents is their easier preparation, because no cost-intensive process or drying steps are necessary, and the easy handling and metering. The use of a combination of hydrogen peroxide with an activator would be advantageous, since this is easier to prepare and safer to handle than an organic peracid. A prerequisite for a commercial use of such liquid bleaching agents based on hydrogen peroxide is that these bleaching agents are stable physically and can therefore be stored without problem for a relatively long time without a noticeable loss of active oxygen.

Liquid bleaching agents based on hydrogen peroxide are already described in EP-A-598 170, EP-A-629 690, EP-A629 691, EP-A629 693, EP-A686 691, WO 93 12 067 and WO 94 11 483. However, the activator used there, acetyl-triethyl citrate (ATEC), shows only an inadequate bleaching action. During the washing process, peracetic acid is formed from this activator, but its activity toward hydrophobic stains is not very pronounced.

Surprisingly, it has now been found that cyclic anhydrides are stable as an activator under certain conditions in the presence of hydrogen peroxide in liquid bleaching agent formulations, and have a significantly higher reactivity toward bleachable stains compared with the prior art. Furthermore, these formulations are significantly less sensitive toward agents which form hardness in the water. The formulations according to the invention furthermore prove to be more reactive against hydrophobic stains, such as ketchup or grass.

The use of alkyl-substituted succinic acids in liquid detergent formulations is known in principle (EP-A-212 723, EP-A-241 073 and WO 92 05 238). These liquid detergents comprise no hydrogen peroxide and the alkyl-substituted succinic acids serve exclusively as builders there. No storage-stable aqueous systems which comprise an anhydride in addition to hydrogen peroxide are known to date. Experience has shown that the anhydride should hydrolyze very rapidly here, and thus have no activating action on hydrogen peroxide.

The invention relates to liquid bleaching agent suspensions comprising essentially a) a mixture of a $C_8$–$C_{18}$-fatty alcohol, oxyethylated with 1–5 units of ethylene oxide, and a $C_8$–$C_{18}$-fatty alcohol, oxyethylated with 6–25 units of ethylene oxide, b) a cyclic anhydride, c) an aqueous solution of hydrogen peroxide and d) water.

It is essential for the bleaching agent suspension according to the invention that it comprises two different surfactants of different degrees of ethoxylation as defined above. The surfactant having a lower content of ethylene oxide preferably contains 2–4 units of ethylene oxide, and the more highly oxyethylated surfactant preferably contains 6–12 units of ethylene oxide. The alcohols on which these surfactants are based can be of natural or petrochemical origin and can be branched or straight-chain.

Examples of alcohols of low degree of oxyethylation are ®Genapol UD-030, 050, Genapol C-050, Genapol O-020, 050, Genapol OA-040, Genapol OX-030, Genapol T-050 or Genapol X-030, 050. Examples of alcohols of medium or high degree of ethoxylation are Genapol OA-070, 080, 089, Genapol OX-060, 080, 100, 109, 130, Genapol O-080, 100, 120, 150, Genapol C-080, 100, Genapol UD-079, 080, 088, 110, Genapol T-080, 100, 110, 150, 180 or Genapol X-060, 080, 150. The fatty alcohol radicals can be identical or different.

The mixing ratio of the two surfactants can be varied within wide ranges. Mixing ratios of fatty alcohols of low to medium or high degree of ethoxylation of 1:4 to 4:1 are preferred. Surfactant mixtures in which the surfactants are present in a ratio of 1:2 to 2:1 are particularly preferred.

It is additionally advisable to use an emulsifier, which should preferably be stable to oxidation, for example mono-, di- or trialkyl phosphates or unsaturated variants thereof. One example of these is stearyl mono/diphosphate.

The total content of surfactants in the bleaching agent suspension is 1 to 50, preferably 2 to 30, in particular 3 to 25% by weight.

All solid or liquid cyclic anhydrides which are virtually water-insoluble at pH 2–6 and room temperature can be used as the bleaching activator in the formulations according to the invention. Cyclic 5-membered ring anhydrides which are derived from maleic acid or succinic acid are particularly preferred. Particularly preferred compounds are branched or straight-chain, optionally additionally substituted alkyl- or alkenyl-substituted maleic or succinic anhydrides of the general formula

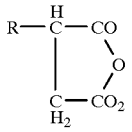

in which R is $C_1$–$C_{22}$-alkyl, $C_2$–$C_{22}$-alkenyl or phenyl.

These compounds can be used by themselves or in combination with another activator from the class mentioned.

Examples of bleaching activators which are to be used according to the invention are methylsuccinic anhydride, ethylsuccinic anhydride, propylsuccinic anhydride, propenylsuccinic anhydride, butylsuccinic anhydride, isobutylsuccinic anhydride, pentylsuccinic anhydride, hexylsuccinic anhydride, heptylsuccinic anhydride, octylsuccinic anhydride, octenylsuccinic anhydride, nonylsuccinic anhydride, nonenylsuccinic anhydride, isononenylsuccinic anhydride, decanylsuccinic anhydride, decenylsuccinic anhydride, dodecenylsuccinic anhydride, tetradecenylsuccinic anhydride, hexadecenylsuccinic anhydride, octadecenylsuccinic anhydride, triacontionylsuccinic anhydride or correspondingly substituted maleic anhydrides.

The concentration of the bleaching activator in the formulation according to the invention is 0.5–30, preferably 3–20% by weight.

The liquid bleaching agent suspensions according to the invention comprise as the essential component hydrogen peroxide in concentrations of between 1 and 30%, preferably 2–10%, calculated as 100% strength $H_2O_2$. It can be employed in a commercial form as a 10, 30, 35, 50 or 70% strength solution. To increase the storage stability, the formulations according to the invention can comprise stabilizers or complexing agents in order to complex heavy metal ions. Examples of such complexing agents are ethylenediaminetetraacetic acid (EDTA), nitrilotriacetic acid (NTA), isoserinediacetic acid, ethylenediaminetetramethylenephosphonic acid (EDTMP), but in particular diethylenetriaminepentamethylenephosphonic acid or substituted triazacyclononanes, such as trimethyltriazacyclononane. The concentration of these compounds can be between 5 ppm and 8%, preferably 10 ppm—5%. In specific applications, for example for the removal of blood-containing stains, a high concentration (about 3–5%) of these substances may be desired. The compounds of this type can be added in the form of the free acid, in partly neutralized form or as salts.

The bleaching agent suspensions according to the invention moreover also contain water in amounts of up to 80% by weight.

An addition of agents for adjustment of the pH can also be necessary, since the formulations have an optimum chemical stability in the acid pH range, in particular between pH 2 and 8, preferably at pH 3–6. All organic or inorganic acids, such as hydrochloric acid, phosphoric acid, sulfuric acid, acetic acid, citric acid and lactic acid, can be used for acidifying the suspension, and inorganic bases or organic amines can be used for rendering it alkaline.

The formulation according to the invention can comprise defoamers, optical brighteners, perfume substances, dyestuffs, antioxidants or hydrogen peroxide as further additives.

The liquid bleaching agents according to the invention can be employed in numerous fields of use, thus, for example, as a detergent additive for textile laundry, as a washing power intensifier, as light duty liquid, as cleaning compositions and disinfectants for hard surfaces and as an all-purpose cleaner or acid abrasive cleaner.

In combination with a liquid or pulverulent detergent, red wine, tea and other bleachable stains are removed without problems during the washing or cleaning process at 20–95° C. These liquid suspensions are particularly suitable as a bleaching component for use in modern multicomponent washing machines, since they are pourable or pumpable.

The bleaching agent can furthermore be employed as a soaking agent or stain remover. The high-viscosity formulations, which can be applied directly to stains, are particularly suitable for this purpose. Pasty formulations can be marketed, for exampe, in tubes or in the form of sticks.

The bleaching agent suspension is employed in concentrations such that the active oxygen content of the wash liquor at the start of the washing process is 0.5–50 ppm, preferably 3–30 ppm of active oxygen.

EXAMPLES

Examples 1–4

The emulsifier (stearyl mono/diphosphate) was melted and the bleaching activator (i-nonenoylsuccinic anhydride) was added. The nonionic surfactants were melted and the mixture described above, water and complexing agent (®Dequest 2066) were added to this melt. The formulation was allowed to cool, while stirring, the pH was brought to 4 with sulfuric acid, the $H_2O_2$ was then stirred in slowly and the mixture was homogenized.

| Example | 1 | 2 | 3 | 4 |
|---|---|---|---|---|
| $C_{11}$-oxoalcohol + 3 EO | 10 | 10 | 5 | 10 |
| $C_{14}/C_{15}$-oxoalcohol + 8 EO | 10 | 10 | 5 | 5 |
| Complexing agent | 2 | 2 | 1 | 1 |
| Bleaching activator | 5 | 5 | 3 | 6 |
| Emulsifier | 3 | 1 | 1 | 3 |
| $H_2O_2$ (35% strength) | 15 | 15 | 10 | 15 |
| distilled water | | to 100 | | |

all figures are % by weight;
EO = ethylene oxide

All the formulations can be stored for longer than 3 months without a phase separation being observed. The formulations are also stable in the temperature fluctuation test (−8° C. to +40° C). The loss of active oxygen after storage for 3 months was a maximum of 15%, determined by iodometric titration before and after storage.

Examples 5–8

The procedure was analogous to Examples 1–4, but dodecenylsuccinic anhydride was employed as the bleaching activator.

Example 9

The procedure was analogous to Example 1, but n-octadecenylsuccinic anhydride was employed as the bleaching activator.

Example 10

The procedure was analogous to Example 1, but tetrapropylenesuccinic anhydride was employed as the bleaching activator.

Washing experiments with a formulation according to Example 1 The bleaching action of the bleaching agent suspensions according to the invention was tested in washing experiments. The washing experiments were carried out in a washing machine (Miele W 723) at 40° C. using water of water hardness 15° dH. The bleaching formulation was spread onto the test fabric and, after an action time of 15 minutes, the fabric was washed in the washing machine with 180 g of ®Dash (Procter & Gamble, Italy). The main washing time was 70 minutes. For comparison, a formulation according to Example 1 in which nonenoylsuccinic anhydride was replaced by acetyl-triethyl citrate (ATEC) was used. Laundry was washed only with the detergent Dash for comparison.

The stains used were bleached cotton and red wine on cotton (EMPA, Switzerland), tea, grass, ketchup and paprika on cotton (WFK, Krefeld). In each case two of these test stains were sewn onto a cotton terry hand towel. In each case two of these hand towels were employed together with 2 kg of ballast laundry per washing operation.

The brightening of the test stains was determined by reflectance measurements after the washing. The values measured are summarized in the following table.

| Washing experiments with formulation: Stain: | 1 | Comparison Example | Dash |
|---|---|---|---|
| Ctn/bleached | 97.6 | 97.5 | 95.4 |
| Ctn/Red wine | 87.4 | 87.0 | 85.3 |
| Ctn/Tea | 69.9 | 67.2 | 64.0 |
| Ctn/Grass | 74.2 | 73.4 | 69.5 |
| Ctn/Ketchup | 91.5 | 90.0 | 89.5 |
| C/tn Paprika | 56.0 | 55.6 | 53.1 |

The washing results demonstrate the bleaching activity of the formulations according to the invention. After a storage time of 3 months, only an insignificant drop in bleaching activity is observed.

We claim:

1. A liquid bleaching agent suspension comprising a) a mixture of a $C_8$–$C_{18}$-fatty alcohol, oxyethylated with 1 to 5 units of ethylene oxide, and a $C_8$–$C_{18}$-fatty, oxyethylated with 6 to 25 units of ethylene oxide, b) a cyclic anhydride selected from

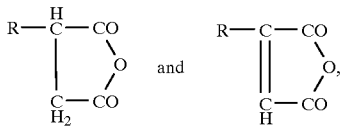

wherein R is $C_1$–$C_{22}$-alkyl, $C_2$–$C_{22}$-alkenyl or phenyl, c) an aqueous solution of hydrogen peroxide and d) water.

2. A liquid bleaching agent suspension as claimed in claim 1, wherein the content of oxyethylated fatty alcohol a) is 1 to 50% by weight, the content of cyclic anhydride b) is 0.5 to 30% by weight, the content of hydrogen peroxide (100% strength) is 1 to 30% by weight and the content of water is up to 80% by weight.

3. A liquid bleaching agent suspension as claimed in claim 1, wherein the pH of the suspension is 2 to 8.

4. The liquid bleaching agent as claimed in claim 1, wherein the mixture of fatty alcohols contains a $C_8$–$C_{18}$-fatty alcohol, oxyethylated with 2–4 units of ethylene oxide, and a $C_8$–$C_{18}$-fatty alcohol, oxyethylated with 6–12 units of ethylene oxide.

5. The liquid bleaching agent as claimed in claim 1, wherein the mixing ratio of the fatty alcohols is 1:4 to 4:1.

6. The liquid bleaching agent as claim in claim 5, wherein the mixing ratio is 1:2 to 2:1.

7. The liquid bleaching agent as claimed in claim 1, wherein the fatty alcohols are present in an amount from 2–30% by weight.

8. The liquid bleaching agent as claimed in claim 1, wherein the fatty alcohols are present in an amount from 3–25% by weight.

9. The liquid bleaching agent as claimed in claim 1, wherein the concentration of the bleaching agent in the formulation is 3–20% by weight.

10. The liquid bleaching agent suspension as claimed in claim 2, wherein the content of hydrogen peroxide is 2–10% by weight.

11. The liquid bleaching agent suspension as claimed in claim 1, wherein the suspension further contains an emulsifier.

12. The liquid bleaching agent suspension as claimed in claim 1, wherein the suspension further contains a stabilizer.

13. The liquid bleaching agent suspension as claimed in claim 1, wherein the suspension further contains a complexing agent.

14. The liquid bleaching agent suspension as claimed in claim 3, wherein the pH of the suspension is 3–6.

* * * * *